United States Patent [19]

Wagle

[11] 4,381,433

[45] Apr. 26, 1983

[54] DRIVE MEANS FOR A TIMING MECHANISM

[75] Inventor: William E. Wagle, Bloomington, Ind.

[73] Assignee: Emhart Industries, Inc., Indianapolis, Ind.

[21] Appl. No.: 414,470

[22] Filed: Sep. 2, 1982

Related U.S. Application Data

[63] Continuation of Ser. No. 205,012, Nov. 7, 1980, abandoned.

[51] Int. Cl.[3] ..... H01H 43/10

[52] U.S. Cl. ..... 200/38 R; 200/38 C

[58] Field of Search ..... 200/35 R, 38 R, 38 FA, 200/38 B, 38 BA, 38 C, 38 CA, 153 LB

[56] References Cited

U.S. PATENT DOCUMENTS

| | | | |
|---|---|---|---|
| 2,803,715 | 8/1957 | Guth | 200/38 C |
| 3,015,003 | 12/1961 | Simmons | 200/38 B |
| 3,331,929 | 7/1967 | Holtkamp | 200/38 C X |
| 3,603,749 | 9/1971 | Davis | 200/38 C |
| 4,060,702 | 11/1977 | Linn | 200/38 C X |

*Primary Examiner*—J. R. Scott

*Attorney, Agent, or Firm*—R. F. Meyer; D. W. Gomes

[57] ABSTRACT

Rotation of a cam means of a timing mechanism is provided by three sets of axially aligned ratchet teeth having different major and minor diameters and a drive pawl selectively engaging the three sets of teeth.

The arrangement provides a means to delay the actuation of switches which control the functions of an appliance.

6 Claims, 5 Drawing Figures

DRIVE MEANS FOR A TIMING MECHANISM

This application is a continuation of application Ser. No. 06/205,012, filed Nov. 7, 1980, now abandoned.

BACKGROUND OF THE INVENTION

Generally speaking, the present invention pertains to a drive means of a timing mechanism which comprises first ratchet teeth of a first major diameter coupled to a cam means; second ratchet teeth of a second major diameter in working relationship with the first ratchet teeth; third ratchet teeth of a third major diameter in working relation with the first and second ratchet teeth; and a drive pawl selectively engaging two of the first, second and third ratchet teeth at a first predetermined period of time to intermittently rotate the same, and a single one of said first, second and third ratchet teeth to intermittently rotate same.

The present invention relates to a timing mechanism and, more particularly, to a timing mechanism having a means to delay the operational program of the timing mechanism.

Timing mechanisms have been used in the appliance industry for many years to control the sequential operation of an appliance such as a washer, dryer, dishwasher and of recent years, microwave ovens. In such applications, it has sometimes been found necessary to apply electrical power to the timing mechanism while at the same time delay the initiation of the program provided by the timing mechanism until a desired starting time. For the most part, the mechanisms used to provide such delay have been complicated, difficult to fabricate, and costly to produce.

FEATURES OR OBJECTS OF THE INVENTION

It is, therefore, a feature of the present invention to provide a timing mechanism having a means to delay initiation of the program provided by the timing mechanism. Another feature of the invention is to provide a timing mechanism wherein such means is simple and easy to produce. Another feature of the invention is to provide such a timing mechanism which utilizes cooperating sets of ratchet teeth of different major diameters. Still another feature of the invention is to provide such a timing mechanism wherein a single drive pawl selectively engages two of the three sets of ratchet teeth during a first predetermined period of time and a single one of the first, second and third ratchet teeth during a second predetermined period of time. These and other features of the invention will become apparent from the following description taken in conjunction with the accompanying drawings.

DETAILED DESCRIPTION OF THE DRAWINGS

Figure 1:
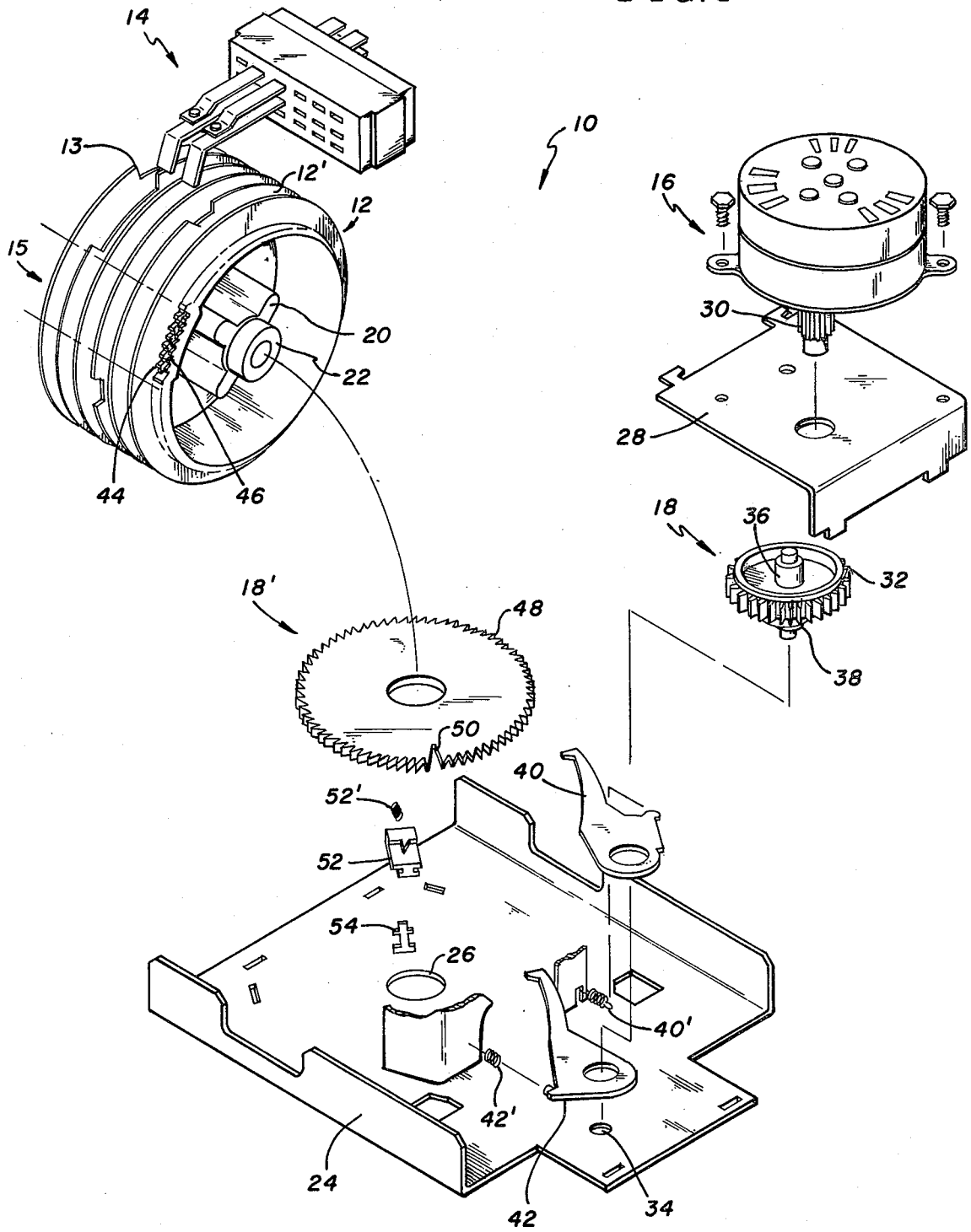
FIG. 1 is an exploded view of a timing mechanism employing the features of the invention.

Referring now to FIG. 1, there is shown a timing mechanism 10 which, in general, includes a cam means 12 which upon rotation selectively opens and closes electrical switch means 14 that engages the cam means, and a motor drive means 16 which applies power driven rotation to the cam means 12 through drive means 18. Cam means 12 includes a plurality of cams 12' having coded indicia 13 thereon and that are integrally formed on a hub portion 20 and a shaft 22, shaft 22 being rotatably journalled in base plate 24 through aperture 26. Motor drive means 16 is carried on a plate 28 which is secured to base plate 24. Motor drive means 16 may be of any suitable type known in the industry such as a synchronous motor.

Drive means 18 includes a motor output pinion 30 which extends through plate 28 and engages a drive gear 32, the drive gear 32 having a major axis defined by hub and shaft 36 which is rotatably journalled in base plate 24 through aperture 34. Gear 32 also includes an eccentric 38 which is slightly off center of the major axis. A drive pawl 40 and a stop pawl or a secondary drive pawl 42 are carried by eccentric 38 to be rotated in accordance with the movement of the eccentric. The portion of the drive means 18 described thus far, as well as the other elements of the timing mechanism previously described, are well known in the art and form no part of the present invention.

Figure 2:
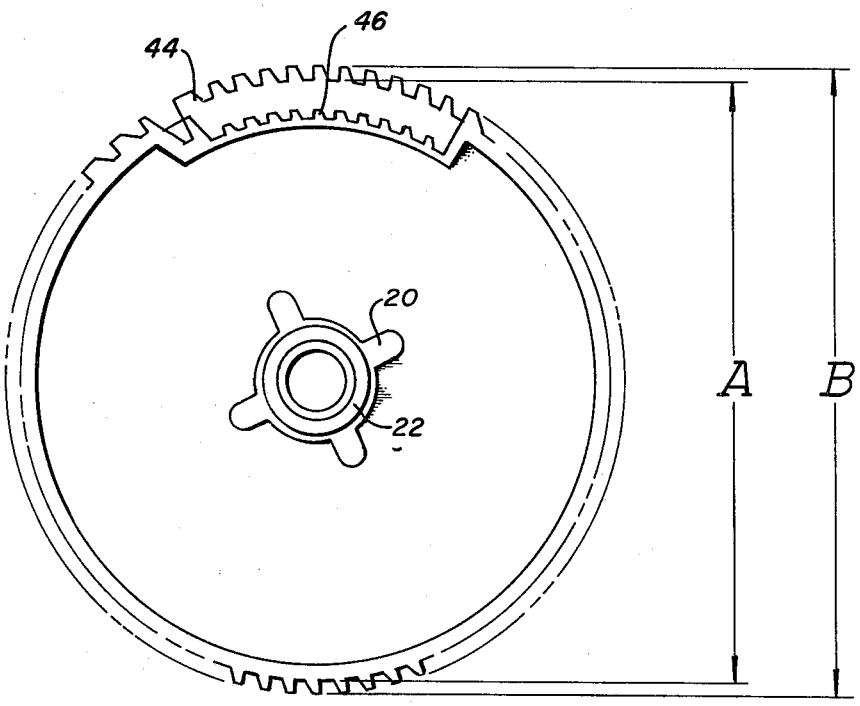
FIG. 2 is a view of a typical ratchet illustrating major and minor diameters.

The present invention is concerned with the drive portion 18' of drive means 18 which provides a means to delay the operation of electrical switch means 14 even though electric power has been applied to the device. Drive means 18' includes first ratchet teeth 44 which are integral with cam means 12, second ratchet teeth 46 which are also integral with cam means 12, and third ratchet teeth 48 which is independently rotatably carried on shaft 22. Each of the ratchet teeth has a major and minor diameter. For the purposes of the present invention the meaning of the terms major and minor diameters are illustrated in FIG. 2. Referring to FIG. 2, a major diameter B is the distance to the outermost point of the teeth while a minor diameter A is a distance to the base of the teeth. Ratchet teeth 46 has a major diameter B which is less than the major diameter of ratchet teeth 44 and a minor diameter A which is also less than the minor diameter of teeth 44. For the sake of clarity, ratchet teeth 48 are not shown in FIG. 2, but they have a major diameter which is less than the major diameter of ratchet teeth 44 but greater than the major diameter of ratchet teeth 46. Such teeth relationship is shown with reference to FIGS. 3–5.

Returning to FIG. 1, and as will be hereinafter explained, drive pawl 40 selectively engages ratchet teeth 48 and ratchet teeth 46 during a predetermined period of time and further engages only ratchet teeth 44 during another period of time. Ratchet 48 includes a notch 50 that is of sufficient depth to provide a minor diameter at least as small as the minor diameter of ratchet teeth 46. Stop pawl or secondary drive pawl 42 engages ratchet teeth 44 to prevent backlash of cam means 12 during its intermittent rotation while slider 52, which is slidably carried in slot 54 of base member 24, engages ratchet teeth 48 to prevent its backlash. Pawls 40 and 42 are spring biased through coil springs 40' and 42' to insure engagement of the pawls with ratchet teeth 44 while slider 52 is spring biased through spring 52' (which engages another frame member of the timing mechanism, not shown) to insure engagement of the slider with ratchet teeth 48 all in a manner well known in the art.

The number of teeth of ratchet teeth 46 corresponds to the amount of delay time desired. For example, each tooth could represent an hour. The location of the teeth and cam means 12 with respect to a zero start time as to the number of delay hours desired can then be manually set by manually rotating an extension of shaft 22 (not shown) through a clutch in a manner well known in the art.

Figure 3:
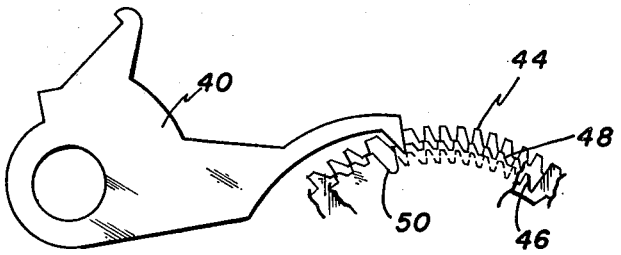
FIGS. 3–5 are similar views illustrating three modes of operation of the drive means of the present invention.

The operation of drive means 18' can now be described with reference to FIGS. 3–5, it being understood that drive pawl 40 and stop pawl 42 are operated through motor drive means 16 and eccentric 38. In FIG. 3, drive pawl 40 is engaging the teeth of ratchet 48 only to drive it alone. Both ratchets 46 and 44 are stationary.

Figure 4:
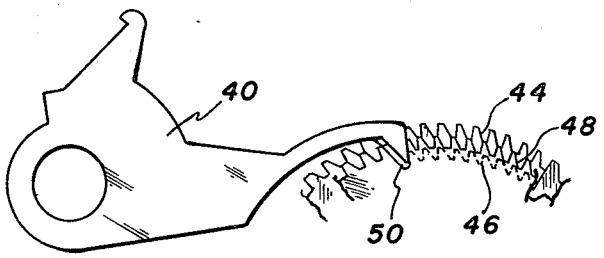

In FIG. 4, drive pawl 40 has engaged slot 50 of ratchet 48. Since, as noted previously, the depth of notch 50 is of sufficient depth to provide a minor diameter at least as small as the minor diameter of ratchet 46, drive pawl 40 will also engage ratchet 46. Since, in the present embodiment, both ratchet teeth 44 and 46 are integral with cam means 12, the cam means will advance one step in accordance with the teeth of ratchet teeth 46. However, it should be understood that during this time, cam means 12 will not be in a position to activate any of the switches of electrical switch means 14. More specifically, and as previously noted, the number of teeth in ratchet teeth 46 corresponds to the delay time. Therefore, a portion 15 (FIG. 1) of the perimeter of cam means 12 that is in line with and approximately equal to the arc length of ratchet teeth 46 will be free of coded indicia 13 which control functions of the appliance so that corresponding switches of switch means 14 cannot be activated.

Figure 5:
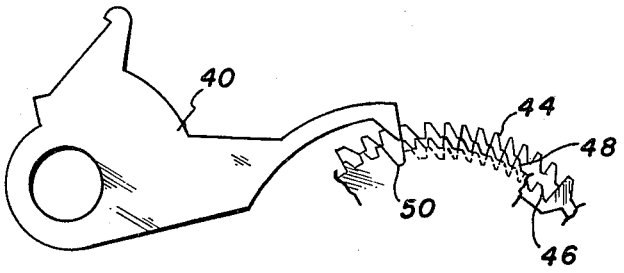

In FIG. 5, drive pawl 40 has passed through ratchet teeth 46 and now engages ratchet teeth 44 for continued intermittent rotation of cam means 12 to start the normal program of the timing mechanism and activate electrical switch means 14.

What is claimed is:

1. A timing mechanism comprising (a) a cam means rotatably carried on a shaft and providing a program and electrical switches opening and closing in response to said program, (b) rotatable first ratchet teeth of a first major diameter carried on said shaft and coupled to said cam means for intermittent rotation therewith, (c) rotatable second ratchet teeth coupled to and in axial alignment with said first rotatable ratchet teeth and of a second major diameter which is less than said first major diameter, (d) rotatable third ratchet teeth carried by said shaft in axial alignment with said first and second ratchet teeth and independently rotatable from said first and second ratchet teeth and having a third major diameter which is less than said first major diameter but greater than said second major diameter and further having at least one notch of sufficient depth to provide a minor diameter at least as small as a minor diameter of said second ratchet teeth, (e) a drive pawl selectively engaging said first and third rotatable rachet teeth and said second ratchet teeth when engaged with said notch, and (f) individual stop means engaging said first and third ratchet teeth.

2. A timing mechanism according to claim 1, wherein said first and second ratchet teeth are carried on said cam means.

3. A timing mechanism according to claim 1 further including clutch means coupled to said shaft to permit manual rotation of same to set said second ratchet teeth in a predetermined position.

4. A method of delaying actuation of electrical switches which control functions of an appliance and that are responsive to a rotation of a cam means comprising:

(a) providing first ratchet teeth of a first major diameter coupled to said cam means, (b) providing a number of second ratchet teeth of a second lesser major diameter than said first major diameter in working relation to said first ratchet teeth, the number of teeth being proportional to a desired time of said delayed actuation, (c) providing a portion of a perimeter of said cam means that is substantially equal to the arc length of said number of said second rachet teeth and in line therewith which is free of coded indicia which control said functions, (d) providing a third set of ratchet teeth of a third major diameter that is less than said first but greater than said second major diameter and further including a notch having a minor diameter which is at least less than a minor diameter of said second ratchet teeth, and (e) providing a drive means driving said cam means and including drive pawl selectively engaging said first and third ratchet teeth and said second ratchet teeth when engaged with said notch.

5. A timing mechanism comprising (a) a cam means rotatably carried on a shaft and providing a program and electrical switches opening and closing in response to said program, (b) rotatable first ratchet teeth of a first major diameter carried on said shaft and coupled to said cam means for intermittent rotation therewith, (c) rotatable second ratchet teeth coupled to and in axial alignment with said first rotatable ratchet teeth and of a second major diameter which is less than said first major diameter, (d) rotatable third ratchet teeth carried by said shaft in axial alignment with said first and second ratchet teeth and independently rotatable from said first and second ratchet teeth and having a third major diameter which is greater than said second major diameter and further having at least one notch of sufficient depth to provide a minor diameter at least as small as a minor diameter of said second ratchet teeth, (e) a drive pawl selectively engaging said first and third rotatable ratchet teeth and said second ratchet teeth when engaged with said notch, and (f) individual stop means engaging said first and third ratchet teeth.

6. A method of delaying actuation of electrical switches which control functions of an appliance and that are responsive to a rotation of a cam means comprising:

(a) providing first ratchet teeth of a first major diameter coupled to said cam means, (b) providing a number of second ratchet teeth of a second lesser major diameter than said first major diameter in working relation to said first ratchet teeth, the number of teeth being proportional to a desired time of said delayed actuation, (c) providing a portion of a perimeter of said cam means that is substantially equal to the arc length of said number of said second ratchet teeth and in line therewith which is free of coded indicia which control said functions, (d) providing a third set of ratchet teeth of a third major diameter that is greater than said second major diameter and further including a notch having a minor diameter which is at least less than a minor diameter of said second ratchet teeth, and (e) providing a drive means driving said cam means and including a drive pawl selectively engaging said first and third ratchet teeth and said second ratchet teeth when engaged with said notch.

* * * * *